United States Patent [19]

Vignot

[11] Patent Number: 4,776,495

[45] Date of Patent: Oct. 11, 1988

[54] DISPOSABLE DISPENSER PUMP FOR PRODUCTS IN LIQUID OR PASTE FORM

[75] Inventor: Eric Vignot, Coubron, France

[73] Assignee: Alpha Systemes, Mitry-Mory, France

[21] Appl. No.: 32,688

[22] Filed: Apr. 1, 1987

[30] Foreign Application Priority Data

Apr. 16, 1986 [FR] France ..... 86 05982

[51] Int. Cl.[4] ..... B65D 37/00; B65D 5/72

[52] U.S. Cl. ..... 222/207; 222/206; 222/212; 222/213; 222/491; 222/494; 222/215

[58] Field of Search ..... 222/206, 207, 212, 213, 222/490, 494, 215, 491; 137/853

[56] References Cited

U.S. PATENT DOCUMENTS 2,902,049 9/1959 Ilfrey et al. ..... 137/853

3,448,766 6/1969 Schüle ..... 137/853

FOREIGN PATENT DOCUMENTS 1017080 10/1957 Fed. Rep. of Germany ..... 222/490

*Primary Examiner*—Joseph J. Rolla

*Assistant Examiner*—Lisa C. Waag

*Attorney, Agent, or Firm*—Young & Thompson

[57] ABSTRACT

A dispenser pump and cartridge forming a single unit which can be discarded after use includes a hollow pump body with an admission valve having flexible lips which separate at the time of use under the action of a pressure gradient established within the product to be dispensed. The pump body also has a delivery valve with a flexible tubular skirt which is inwardly deformable and capable of moving locally away from an annular sealing lip, thus permitting downward escape of a dose of product. Subsequent re-closing of the skirt prevents any upward admission of external air.

2 Claims, 3 Drawing Sheets

Fig: 3
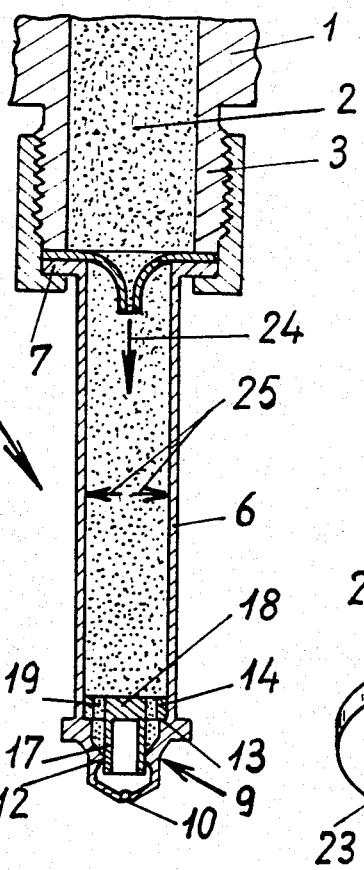
Fig: 7
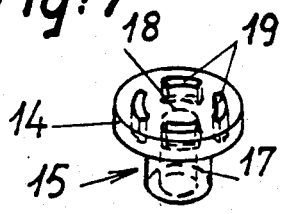
Fig: 5
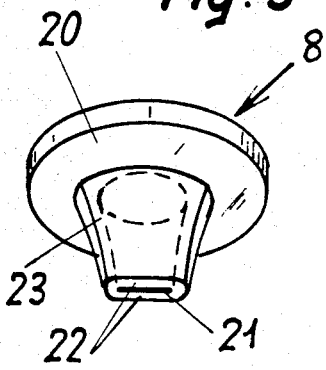
Fig: 6
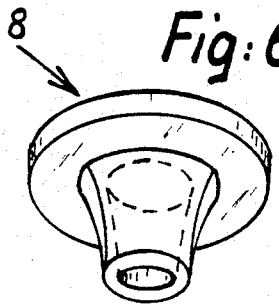
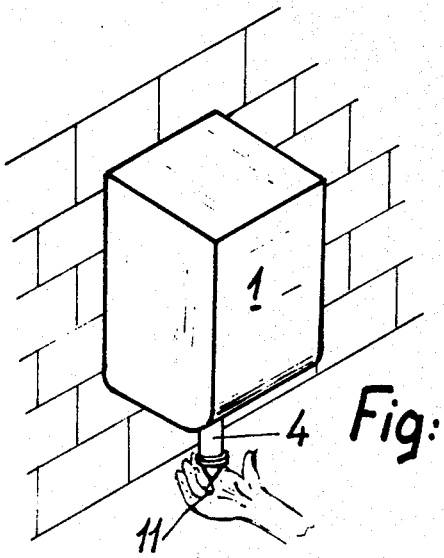
Fig: 4

DISPOSABLE DISPENSER PUMP FOR PRODUCTS IN LIQUID OR PASTE FORM

BACKGROUND OF THE INVENTION

1. Field of the Invention

The present invention relates to a dispenser pump of a novel type for dispensing liquid products which may be very fluid (alcohol), of creamy consistency or more or less viscous (liquid soap, shaving cream, and so on).

2. Description of the Prior Art

Dispenser pumps of this type are already known but are subject to various drawbacks in all cases.

In the first place, they often have a complex structure which entails high production cost. It is consequently necessary to make provision for re-use of these pumps with a number of successive refills of the product to be dispensed. This gives rise to problems of asepsis when it is desired to employ them, for example, in the operating theater of a hospital.

It should further be mentioned that the majority of known pumps allow external air to flow upwards into the product after each use. These pumps consequently have a tendency to clog as a result of drying of the product. In addition, admissions of air again present a problem of asepsis for medical uses.

SUMMARY OF THE INVENTION

The aim of the present invention is to provide a simple and inexpensive dispenser pump which satisfies even the most stringent conditions of asepsis. Furthermore, a pump of this type can be designed in a disposable form and may accordingly be manufactured at the same time as the cartridge containing the product to be dispensed, both pump and cartridge being discarded after use.

In one alternative embodiment of the invention in which the pump is intended to be placed beneath the bottom discharge outlet of a container filled with the liquid product to be dispensed, the pump has a hollow body equipped with an admission valve at the upper end thereof and with a delivery valve at the lower end thereof. The dispenser pump is distinguished by the fact that the pump body is constituted by a tubular wall of flexible material whilst the admission valve is designed in the form of a tubular mouthpiece of flexible material having a downstream portion of flattened shape so as to define a transverse slit located between two lips which maintain the mouthpiece elastically closed when the admission valve is at rest whereas said lips separate under the action of a pressure gradient which appears within the liquid to be dispensed.

In accordance with another distinctive feature of the invention, the delivery valve has an annular sealing lip which forms an inward projection within a discharge nozzle, the deformable tubular skirt of a closure tube being mounted within said discharge nozzle. In the rest condition, said deformable tubular skirt is in a fluid-tight position within the annular sealing lip and is closed at the upper end by a transverse end-wall whilst the liquid circulates only externally around the skirt.

BRIEF DESCRIPTION OF THE DRAWINGS

FIGS. 2 and 3 illustrate two stages of operation of the pump.

FIG. 4 shows the use of a wall-mounted dispenser equipped with the pump in accordance with the invention.

FIGS. 5 and 6 are views in perspective showing the admission valve respectively in the closed position and in the open position.

FIGS. 7 shows the closure tube which constitutes the delivery valve.

DESCRIPTION OF THE PREFERRED EMBODIMENTS

Figure 1:
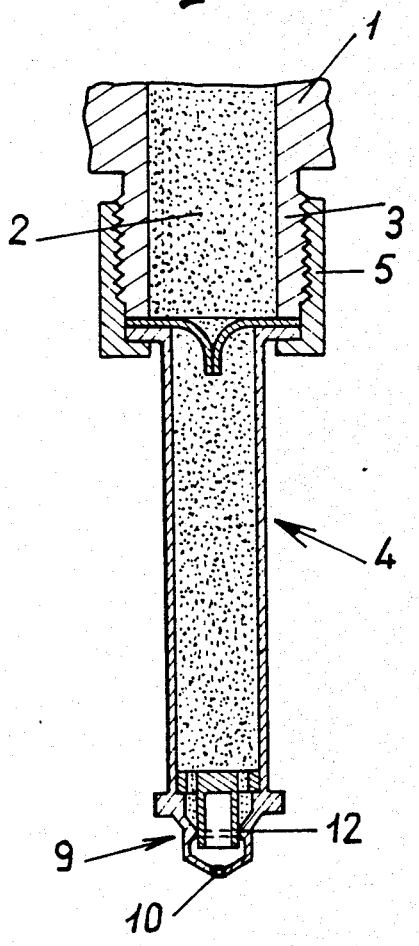
FIG. 1 is a longitudinal sectional view of a dispenser pump in accordance with the invention when the pump is at rest.

There is illustrated in the drawings a container or cartridge 1 which contains the liquid 2 to be dispensed and is provided with an outlet 3 at the lower end. The dispenser pump 4 in accordance with the invention is fitted in position beneath the lower end of the container by any suitable means of known type such as, for example, by welding or screwing a threaded sleeve 5 as has been assumed in FIGS. 1 to 3.

The pump 4 has a tubular body 6 provided at the upper end with an annular flange 7 on which an admission valve 8 is applied and at the lower end with a discharge nozzle 9.

The nozzle 9 is provided at the lower end thereof with an orifice 10 for discharging a dose 11 of product 2.

An annular lip 12 is formed at mid-height on the nozzle 9 and projects into the internal space of this latter.

An internal annular recess 13 is provided at the upper end of said nozzle 9 and is intended to receive the annular flange 14 which is provided at the top of a closure tube 15.

Figure 2:
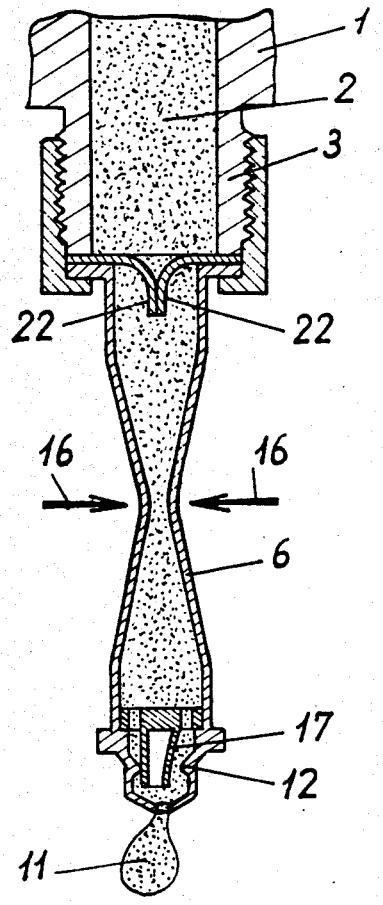

The pump body 6 is formed of flexible molded material which can be squeezed between the user's fingers as indicated schematically in FIG. 2 by the arrows 16.

The closure tube 15 is provided with a flexible cylindrical skirt 17 which is closed at the top by a transverse end-wall 18. Around this latter is placed the annular flange 14 in which are cut arcuate slots 19 for allowing the product 2 to flow freely around the skirt 17.

After assembly and in the state of rest, the closure tube 15 is maintained in position within the recess 13 by the annular flange 14 (as shown in FIG. 3) whilst the skirt 17 is resiliently held in position by the sealing lip 12 which surrounds said skirt.

The admission valve 8 is formed in one piece and made of flexible molded material. This valve is designed in the form of a transverse annular flange component 20 having a downward extension in the form of a tubular mouthpiece 23 having a downstream end which is of flattened shape so as to define a transverse slit 21. This slit is located between two flexible lips 22 which remain applied against each other in fluid-tight manner when the valve 8 is closed (as shown in FIGS. 2 and 5).

When, on the contrary, a pressure gradient appears from the upstream end to the downstream end within the product 2, the lips 22 separate and open the slit 21 which allows the product 2 to pass through (as indicated by the arrow 24 in FIG. 3 and in FIG. 6).

The operation of the dispenser is as follows:

When the apparatus 1, 4 is at rest, the valves 8 and 9, 15 are both closed (as shown in FIG. 1) and the pump 4 is full of product 2 throughout the space located above the sealing lip 12 of the nozzle 9. In consequence, air cannot pass into the pump, thus ensuring asepsis of the product 2 and guarding against desiccation of this latter.

When the user squeezes the tubular wall of the pump body 6 (as indicated by the arrow 16 in FIG. 2), the admission valve 8 remains hermetically closed under the upward thrust which tends to reapply the lips 22 even more tightly against each other. On the other hand, the downward thrust exerted on the exterior of the skirt 17 of the closure tube 15 causes inward deformation of said skirt 17 which moves locally away from the annular lip 12 and allows the dose 11 of product 2 to escape in the downward direction.

When the user releases the pump 4 (as shown in FIG. 3), the pump body 6 returns elastically to its initial position (as shown by the arrows 25) and the skirt 17 recloses against the sealing lip 12. Any upward admission of air through the nozzle 9 is thus prevented.

On the other hand, the pressure gradient which appears between the upstream end and downstream end of the admission valve 8 has the effect of separating the lips 22 (see FIGS. 3 and 6) in order to allow the product 2 contained in the cartridge 1 to penetrate into the body 6 of the pump 4 (arrow 24) which is thus ready to be recharged for further use.

It is apparent from the foregoing that the pump in accordance with the invention can be manufactured at very low cost and can consequently be of disposable design. In particular, it is possible at the time of manufacture to integrate the pump with the cartridge 1 which contains the product 2. The complete unit can accordingly be delivered in a sterile form and subsequently discarded after use. This makes the pump particularly well-suited for medical and surgical applications.

Figure 8:
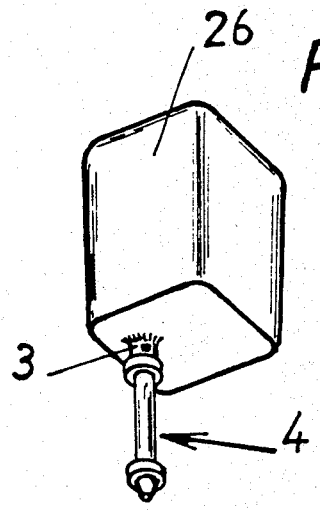
FIGS. 8 and 9 show an alternative embodiment in which the pump forms together with its deformable and rigid bottle a single unit which can be discarded after use.
Figure 9:
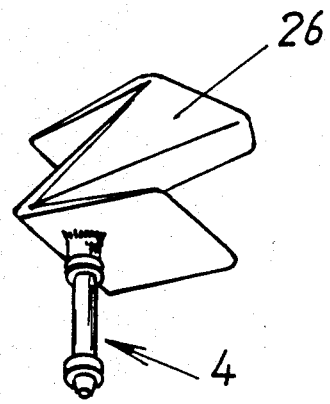

In the alternative embodiment illustrated in FIGS. 8 and 9, the pump 4 is permanently welded to the single bottom opening 3 of a bottle 26. The distinctive feature of this bottle lies in the fact that it is made of plastic material which is both rigid and deformable. Thus, when it is new and full of liquid 2, the bottle has a well-defined initial shape (for example a parallelepipedal shape as shown in FIG. 8) and may accordingly be adapted to a wall-mounted dispenser. When the dispenser is in service, however, and the liquid 2 is progressively drawn-off without any admission of air into the bottle 26, the bottle gradually collapses by deformation as shown in FIG. 9. The unit 4-26 may thus be discarded when the bottle 26 is completely empty.

What is claimed is:

1. A dispenser pump adapted to be connected to the bottom discharge outlet (3) of a container (1) filled with a liquid product (2) to be dispensed, comprising:

a tubular hollow body of flexible material provided at its upper end with an inlet valve and at its lower end with an outlet valve, said inlet valve (8) comprising a tubular neck of flexible material having a flattened downstream end to provide a transverse slit (21) formed between two lips (22) closing said slit by their inherent resiliency when said inlet valve (8) is inoperative, said delivery valve comprising an external nozzle (9) having, intermediate its height, a radially inwardly extending inner annular rib (12) and an inner sealing skirt (17) of annular configuration disposed in said nozzle surrounded by and engaging in sealing position the inner rib (12) of said nozzle; and a closure partition (18) disposed at the upper end of said skirt (17), a plurality of passages (19) being formed through said closure partition (18) to permit passage of a said product to be dispensed between said inner skirt (17) and said external nozzle (9).

2. The dispenser pump of claim 1, wherein said closure partition (18) comprises a radially outwardly extending collar (14) having said plurality of passages (19) formed therethrough for the passage of the product to be dispensed, said collar (14) being disposed in an inner annular recess (13) of said external nozzle (9).

* * * * *